US009362068B2

(12) United States Patent
Huget et al.

(10) Patent No.: US 9,362,068 B2
(45) Date of Patent: Jun. 7, 2016

(54) SWITCHING ARRANGEMENT AND HOUSEHOLD APPLIANCE COMPRISING SUCH SWITCHING ARRANGEMENT

(75) Inventors: Frank Huget, Weinheim (DE); Christoph Blüml, Schillingsfürst (DE)

(73) Assignee: ELECTROLUX HOME PRODUCTS CORPORATION N.V., Brussel (BE)

( * ) Notice: Subject to any disclaimer, the term of this patent is extended or adjusted under 35 U.S.C. 154(b) by 208 days.

(21) Appl. No.: 13/640,160

(22) PCT Filed: May 12, 2011

(86) PCT No.: PCT/EP2011/002341
§ 371 (c)(1),
(2), (4) Date: Dec. 21, 2012

(87) PCT Pub. No.: WO2011/147533
PCT Pub. Date: Dec. 1, 2011

(65) Prior Publication Data

US 2013/0199904 A1 Aug. 8, 2013

(30) Foreign Application Priority Data

May 27, 2010 (EP) ..... 10005483

(51) Int. Cl.

| | |
|---|---|
| ***H01H 3/16*** | (2006.01) |
| ***H01H 21/00*** | (2006.01) |
| ***F24C 15/02*** | (2006.01) |
| ***H01H 13/18*** | (2006.01) |

(52) U.S. Cl.
CPC ..... *H01H 21/00* (2013.01); *F24C 15/023* (2013.01); *H01H 13/183* (2013.01); *H01H 3/162* (2013.01)

(58) Field of Classification Search
CPC ..... H01H 3/16; H01H 3/161; H01H 3/162; H01H 13/18; H01H 13/183; H01H 13/186; H01H 21/28; H01H 21/282; H01H 21/285
USPC ..... 200/61.62, 61.7, 333
See application file for complete search history.

(56) References Cited

U.S. PATENT DOCUMENTS 2,968,710 A 1/1961 Horberg
4,967,045 A * 10/1990 Keefer ..... H01H 13/183 200/296

(Continued)

FOREIGN PATENT DOCUMENTS

JP 60181523 9/1985
WO 2005052970 6/2005

OTHER PUBLICATIONS

International Search Report for PCT/EP2011/002341, dated Jun. 27, 2011 2 pages.

*Primary Examiner* — Renee S Luebke
*Assistant Examiner* — Lheiren Mae A Caroc
(74) *Attorney, Agent, or Firm* — Pearne & Gordon LLP

(57) ABSTRACT

A switching arrangement for detection of displacement of a movable member (80, 62, 86) of a household appliance comprises: (a) a switch (76, 84) having an control element (78, 116) which is movable between a first position in which the switch assumes a first switching condition and at least one second position in which the switch assumes a second switching condition; and (b) an actuation member (68, 82) adapted for connection to said movable member (80, 62, 86) and having a cam surface engaging said control element (78, 116).

14 Claims, 3 Drawing Sheets

(56) References Cited

U.S. PATENT DOCUMENTS 5,690,206 A * 11/1997 Carroll et al. ..... 192/136
5,728,985 A * 3/1998 Hapke et al. ..... 200/61.62
2005/0067265 A1 * 3/2005 Hung ..... 200/61.62

* cited by examiner

SWITCHING ARRANGEMENT AND HOUSEHOLD APPLIANCE COMPRISING SUCH SWITCHING ARRANGEMENT

The present invention relates to a switching arrangement for detection of displacement of a movable member of a household appliance as well as a household appliance comprising such switching arrangement.

In household appliances, such as dishwashers or ovens, often switching arrangements are employed by which a displacement of a movable member of such household appliance is detected, such as the door of such dishwasher or oven, so as to operate certain components of such household appliance in dependency of a displacement of the movable member.

Thus, for example door switches are known which are provided in the front part of the housing of the household appliance to detect whether the door is closed. In particular, push button switches were provided which are actuated by the door when the door is closed and which are released when the door is opened, so as to interrupt for example the operation of a circulation pump in a dishwasher and/or to illuminate an interior light in a dishwasher or oven when the door is opened.

A disadvantage of such switches is that such switches only can detect whether the door is fully closed. That is, as soon as the door is unlocked and is opened by a small degree a switching action occurs. However, for certain purposes it would be advantageous to be able to provide for a switching occurrence in an intermediate position of the movable member. For example, if the switch is employed to turn on an interior illumination of a dishwasher, such illumination should only be turned on when the door is opened by a substantial degree, for example by at least 45°, but to maintain the illumination in the turned-off condition for smaller opening angles, so that a user can open the dishwasher door by a small degree, for example by 10° so as to vent the interior of the dishwasher after completion of a washing operation without the illumination of the dishwasher being turned on.

A further disadvantage of the above door switches is that such switches have to be provided in a region in which a sealing function has to be established, such as in a dishwasher to prevent water from escaping from the interior of the dishwasher or in an oven to prevent heat from escaping from the oven muffle. Providing a switch in a sealing region usually involves specific measures so as to avoid on the one hand that the switch corrupts the sealing function, and on the other hand to avoid that the switch comes into contact with any media for which sealing is to be provided, such as water, hot air or moisture, which thus increases the complexity of the switching arrangement.

It is an object of the present invention to provide for a switching arrangement for detection of displacement of a movable member of a household appliance which overcomes the above disadvantages, and particularly to provide for a switching arrangement which can be installed in a simple manner in the household appliance.

The above object is solved by a switching arrangement for detection of displacement of a movable member of a household appliance which comprises a switch having a control element which is movable between a first position in which the switch assumes a first switching condition and at least one second position in which the switch assumes a second switching condition, and an actuation member adapted for connection to said movable member and having a cam surface engaging said control element.

By providing for an actuation member having a cam surface which engages the control element, the switch can be used to not only detect a terminal position of the displacement of the movable member but rather switching conditions can be assigned over the full range of displacement of the movable member. Furthermore, by providing an actuation member having a cam surface, a plurality of different switching conditions can be assigned to different positions of the movable member. Thus, for example if the switching arrangement is employed in a dishwasher, the switching arrangement can be designed to stop operation of a circulation pump by which water is distributed within the washing chamber as soon as the door is opened, wherein when the door is further opened an interior light is switched on and when the door is fully opened and a drain pump is activated and operation of the dishwasher is not only interrupted but is terminated.

Furthermore, by providing for an actuation member that is adapted for connection to the movable member, the switching arrangement suggested herein can be employed for retrofitting already existing household appliances, so as to upgrade such household appliances by providing for additional functions. Thus, if the switching arrangement is to be installed in a gas oven in order to implement a function that the gas supply to gas burners provided within the oven muffle is terminated when the oven door is opened, the actuation member can be attached to a movable member of the hinge mechanism of the oven door in proximity to a switch which operates an electromagnetic safety valve for interrupting the gas supply.

Preferred embodiments of the present invention are defined in the dependent claims.

The switch can be a push button switch, in which the control element comprises a spring-biased stem projecting from the switch, in which case the cam surface can comprise a ramping section to press down the stem at a certain displacement of the movable member. In this manner activation of the push button switch can be assigned to a certain range of displacement of the movable member, such as a linearly moving member. In such embodiments the switch is located such, that the linearly moving member and hence the actuation member connected thereto move alongside the switch, wherein the ramping section of the actuation member provides that the linear movement of the actuation member in for example a horizontal direction is transformed into a vertical movement of the control element of the switch.

In particular, since household appliances such as ovens or dishwashers which have a door that is pivotable about a horizontal axis often have hinge mechanisms which provide for a balancing function so as to at least partially compensate the weight of the door, wherein such balancing systems comprise members that execute a substantially linear movement over the range of displacement of the door, by connecting the actuation member to such a linearly moving member of the hinge mechanism, a certain switching operation can be assigned to any desired position of the door.

In embodiments in which the actuation member comprises a ramping section so as to press down the stem of a push button switch, the cam surface can further comprise a plateau section into which the ramping section merges, so as to maintain the stem in the pressed down position. Thus, if this switching arrangement is employed for example to activate an interior light of a dishwasher or oven, the ramping section of the cam surface when engaging the push button will cause to switch on the interior light and the plateau surface than will cause the switch to be maintained pressed so as to maintain the interior light in the switched on condition.

In order to facilitate attachment of the actuation member to the movable member of the household appliance, the actuation member can comprise an elastic clamping section for connection to the movable member. Such clamping section can comprise one or more elastic claws which embrace the movable member, or, alternatively or additionally, in embodiments in which a recess or opening is provided in the movable member, the clamping section of the actuation member can be comprise a projection for engaging the recess, wherein the projection provides for an axial or lateral biasing force so as to anchor the projection within the recess. By providing for such clamping section the actuation member thus is adapted for a clip-on or snap-on connection to the movable member, so that the actuation member can be easily mounted to the movable member without further connection means being required. The clamping section thus not only facilitates mounting of the actuation member, but is of particular advantage in cases where the switching arrangement is employed for retrofitting and existing household appliance.

The actuation member can comprise a molded plastic part which allows a high freedom of design of the actuation member at moderate costs.

In a second aspect, the present invention is a household appliance comprising a pivotable door and a switching arrangement as it was referred to above, wherein the pivotable member is a component of a hinge mechanism of the door.

Exemplary embodiments of such household appliances are a kitchen appliances in which certain components are to be activated or deactivated independency of the angular position of a cover element or a door, such as an interior lighting which shall be turned on when a certain opening angle of the door is reached, a gas range in which the gas supply to the burner nozzles shall be interrupted when a cover is closed over the burner nozzles, or a gas oven in which the gas supply to burner nozzles provided within the oven muffle shall be interrupted when the door reaches a certain opening angle.

The component which is to be controlled by the switch can be of any kind, such as an electric component, an electric circuitry such as electric control means, a hydraulic element such as an electromagnetic valve for controlling water, air or gas feed, and the like.

In embodiments in which the switch is used to provide for control in dependency of the displacement of a door of the household appliance, the actuation member preferably comprises a clip which is attached to a component of the hinge mechanism for such door, wherein the component is subject to a substantially linear movement, wherein in order to activate and deactivate the switch, the actuation member comprises a slanted cam surface which engages a push button of the switch. In such embodiments standard push button switches can be used as switch. Furthermore, the switch is provided within the household appliance in the region of the hinge mechanism, i.e. in a housing region in which in contrast to conventional door switches no specific measures have to be taken in terms of fluidic or thermal isolation.

Furthermore, by attaching the actuation member to a component of the hinge mechanism which is subject to a substantially linear movement during movement of the door, simply by selecting a positioning of the switch and a geometric shape of the cam surface of the actuation member, any desired switching scheme can be implemented in dependency of the position of the door. Thus, it not only is possible to provide for a switching action only until a certain opening angle of the door is reached. Rather, also more complicated and multi-stage switching operations can be easily implemented.

Preferred embodiments of the present invention are explained in further detail below by reference to the drawings in which.

FIGS. 1 to 4 illustrate a hinge mechanism for the door of a gas oven which is adapted to switch off the gas supply to burner nozzles for heating the oven muffle, when the door is opened by a predetermined angle. To this end, an electromagnetic valve is provided in the gas supply line, which valve can be activated by a switch 76 (see FIGS. 2 to 4), so as to shut off the gas supply to the burner nozzles.

Figure 1:
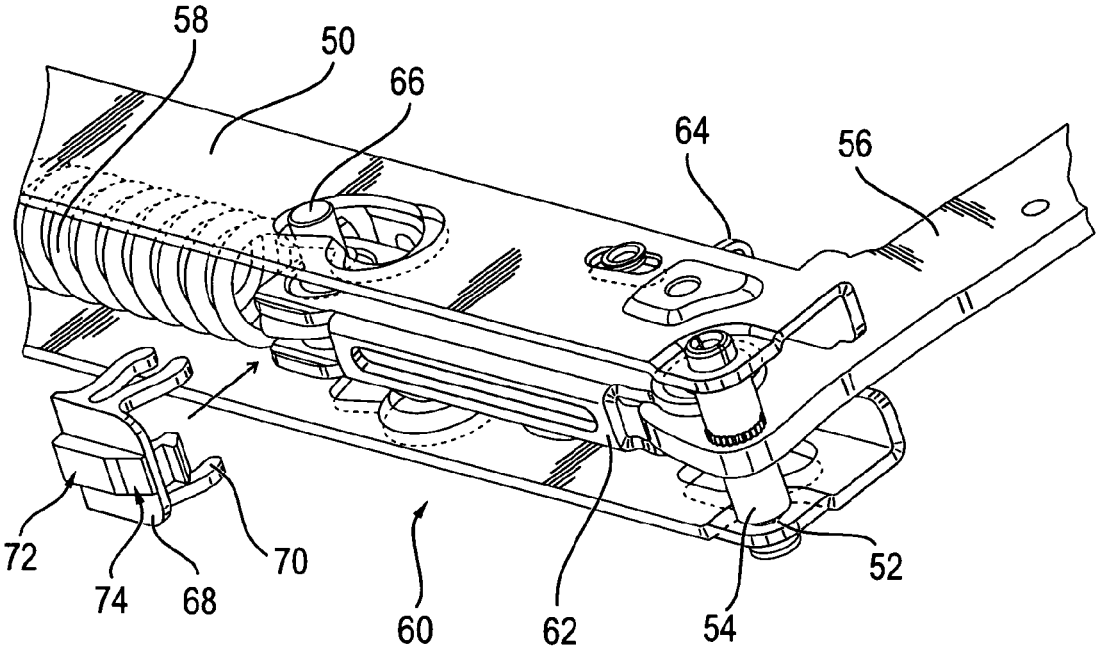
FIG. 1 is a perspective view of a hinge mechanism for a gas oven.
Figure 2:
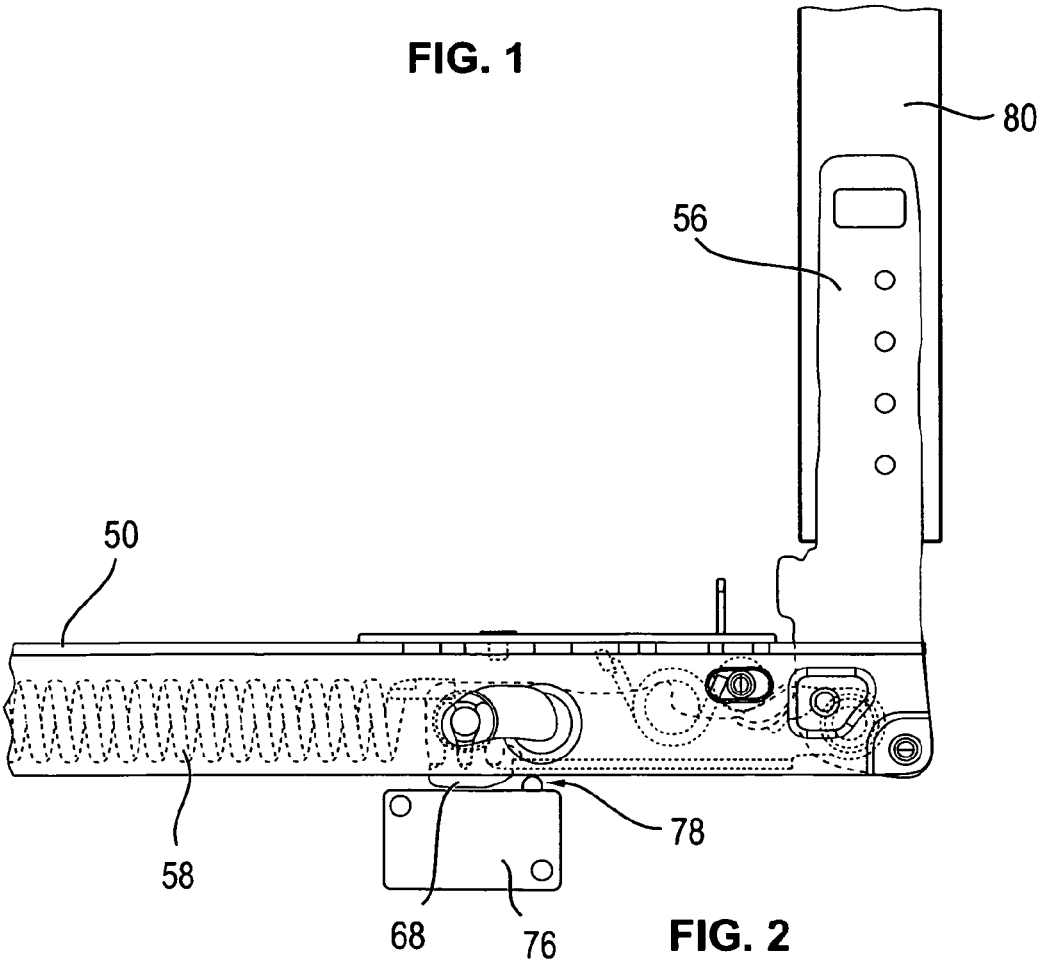
FIGS. 2 to 4 are schematic side views of the hinge mechanism shown in FIG. 1 in different operational positions.

As can be seen particularly in FIGS. 1 and 2, the hinge mechanism comprises a generally U-shaped mounting member 50 which is adapted for connection to the housing of the gas oven. Mounting member 50 comprises close to its front end a bearing journal 52 for the axle 54 of a hinge bracket 56 to which there is mounted the oven door (see door 80 in FIG. 2). In order to decelerate the door when opening the door, the hinge mechanism shown in FIGS. 1 to 4 comprises a balancing means comprising an extension spring 58 which is linked to hinge bracket 56 so as to be tensioned when the door is opened.

In the embodiment shown in FIGS. 1 to 4, a quick release mechanism 60 is interconnected between hinge bracket 56 and extension spring 58. Quick release means 60 allows to remove the entire door 80 from the gas oven so as to facilitate cleaning thereof. As is illustrated in FIG. 1, quick release means 60 comprises a connector 62 which is hinged to hinge bracket 56 of the door. To activate quick release means 60, a lever 64 is tilted towards the opened door. When then the door is partially closed, lever 64 is engaged by a projection provided at hinge bracket 56 so as to activate the release mechanism. Since the release mechanism 60 as such is conventional, further description thereof will be omitted herein. However, it should be understood that when opening the oven door 80, connector 62 and hence axle 66 which is provided at the rear end of connector and to which extension spring 58 is hooked, performs a substantially linear movement.

With the position of axle 66 thus being representative of the angular position of oven door 80 which is attached to hinge bracket 56, in order to implement a gas supply shut off function, an actuation member 68 for activation of the switch 76 is provided, which is designed as a clip comprising flexible tongues 70 by means of which clip 68 can be attached to axle 66.

Clip 68 comprises a plateau surface 72 and a ramping surface 74 which merges into plateau surface 72. Plateau surface 72 and ramping surface 74 are adapted to operate the switch 76 which is provided below mounting member 50. Switch 76 comprises a push button 78 which when the oven door is opened is engaged first by ramping surface 74 and then by plateau surface 72. In particular, when oven door 80 is in the closed position shown in FIG. 2, push button 78 of switch 76 is in its extended position in which switch 76 supplies an electric current to an electromagnetic valve provided in the gas supply line. The electromagnetic valve is biased into its closed position, so that the electromagnetic valve only allows gas to flow to the burner nozzles, when the electromagnetic valve is energized.

Figure 3:
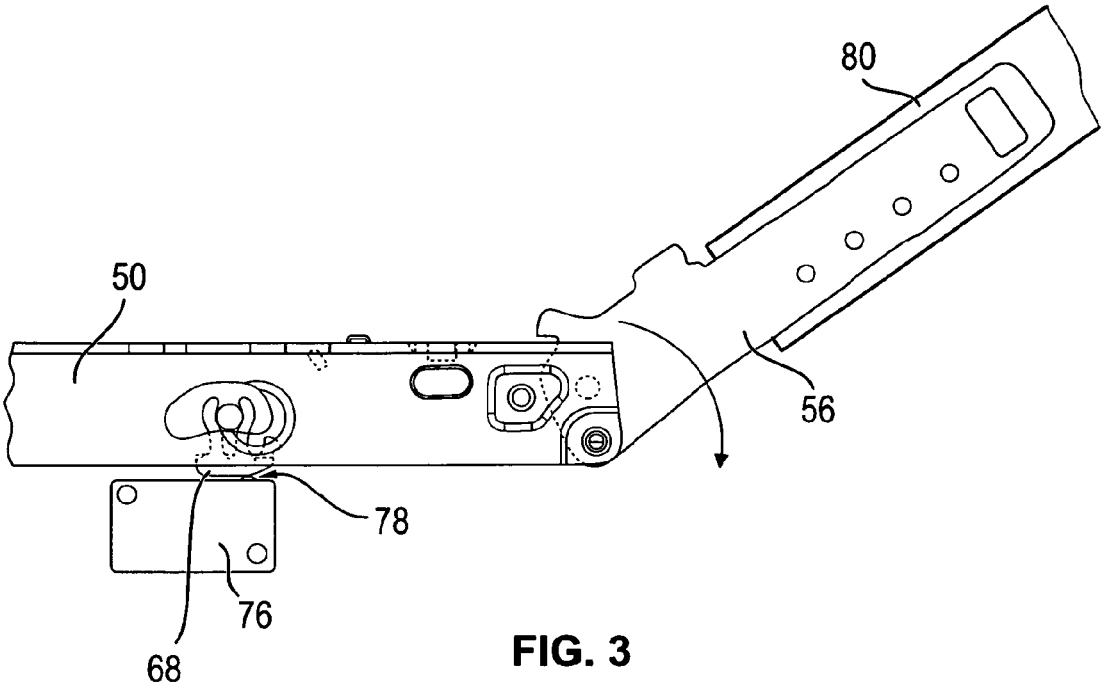

When during opening of the oven door 80, as it is illustrated in FIG. 3, the door reaches a certain opening angle, ramping surface 74 of clip 68 engages push button 78 and thus pushes down push button 78 so that switch 76 interrupts the supply of electric current to the electromagnetic valve. Thus, the gas supply to the burner nozzle is shut off.

Figure 4:
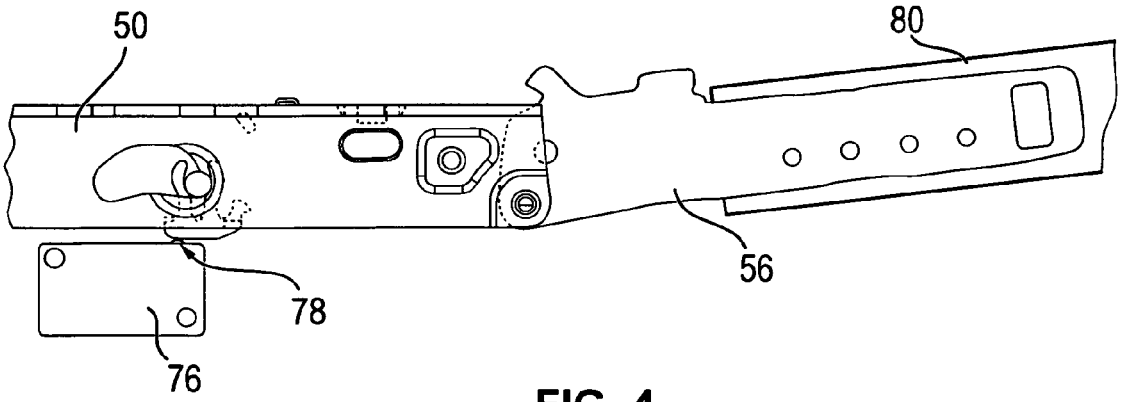

When further opening the door until door 80 reaches its fully opened position, as it is illustrated in FIG. 4, push button 78 is maintained in its pushed-down position by means of the plateau surface 72 so that switch 76 continues interrupting the power supply to the electromagnetic valve.

By selecting an appropriate position of switch 76 with respect to the path of movement of clip 68, it can be selected at which opening angle switch 76 interrupts the power supply to electronic valve 16. Thus, if the arrangement shown in FIG. 2 shall be modified so as to cause switch 76 to interrupt the power supply to electromagnetic valve 16 at a smaller opening angle of door 80, switch 76 will be located further to the rear (in FIG. 2 further to the left) so that ramping surface 74 of clip 68 contacts push button 78 at a smaller opening angle of door 80.

It is to be understood that the switching arrangement shown in FIGS. 1 to 4 similarly could be employed to switch on an interior light of an oven or a dishwasher when a certain opening angle of the door is reached.

Figure 5:
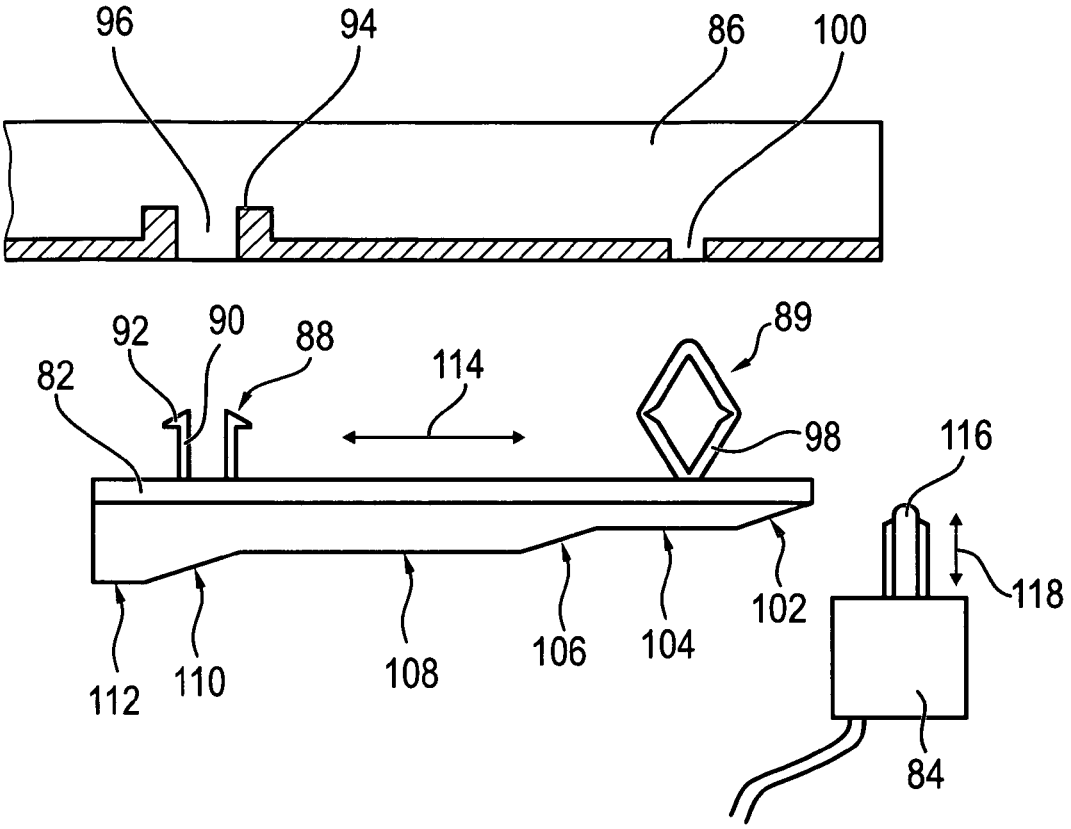
FIG. 5 illustrates an another embodiment of a switching arrangement.

In FIG. 5 there is shown an actuation member 82 which provides for activation of a multistage switch 84. Actuation member 82, which comprises a molded plastic part, is designed as a clip-on member which can be attached to a movable member 86 of a household appliance by means of fastening members 88 and 89 which are integrally formed at actuation member 82 so as to project towards movable member 86. Fastening member 88 comprises a pair of projections 90 which at their free end comprise a hook 92, which when actuation member 82 is attached to movable member engages a rim 94 of an opening 96 provided within movable member 86. The free ends of projections 90 are beveled so that when actuation member 82 is mounted at movable member 86, projections 90 are slightly bent towards each other. As soon as hooks 82 have passed opening 96 projections 90 return to their original state and thus latch fastening member 88 with respect movable member 86.

Fastening member 89 likewise is adapted for clip-on connection to movable member 86. To this end fastening member 89 comprises two angled legs 98 which are joined at their ends, wherein legs can be elastically deformed when fastening member 89 is inserted in an opening 100 provided within movable member 86, so as to spring back towards their original shape, thus providing for a biasing force to attach actuation member 82 to movable member 86.

Switch 84 which is to be operated by means of actuation member 82 is a multistage switch which in the embodiment shown in FIG. 5 provides for four different switching conditions. To this end actuation member 82 comprises a first ramping surface 102 which merges into a first plateau surface 104, a second ramping surface 106 which merges into a second plateau surface 108, and a third ramping surface 110 merging into a third plateau surface 112. When movable member 86 and correspondingly actuation member attached thereto is moved in the direction of arrow 114, actuation member 82 will convert such movement into a corresponding movement of control element 116 of switch 84 in the direction of arrow 118.

When employed in a dishwasher, the switching arrangement shown in FIG. 5 can be employed to control operation of the dishwasher independency of the position of the dishwasher door. Similarly as for the switching arrangement described above by reference to FIG. 1 to FIG. 4, movable member 86 shown in FIG. 5 can be part of the hinge mechanism for the dishwasher door and in particular can be a horizontally moving component of a balancing mechanism for balancing the weight of the dishwasher door. When the dishwasher door is closed actuation member 82 and control element 116 of switch 84 will be located in close proximity to each other or, as is shown in FIG. 5, at a small distance so that control element 116 is in its fully extended position. When control element 116 is fully extended, switch 84 provides a first control signal by which the device control of the dishwasher on the one hand allows a washing operation to be carried out and on the other hand turns off an interior light by which the interior of the washing tub can be illuminated.

When the dishwasher door is opened movable member 86 and hence actuation member 82 is moved to the right in FIG. 5 so that ramping surface 102 engages control element 116 of switch 84 until the first plateau surface 104 is reached. In this manner control element 116 is moved into a second switching condition in which switch 84 sends a second control signal to the device control by which the operation of a circulation pump, by which water is circulated through the interior of the washing tub is terminated. When the dishwasher door is further opened, control element 116 eventually will reach the second ramping surface 106 so that control element is further depressed until the second ramping surface 108 is reached. Depression of control element 116 to the level of second plateau surface 108 sets switch 84 into a third switching condition in which a third control signal is sent to the device control by which the interior light within the washing top is turned on.

When the dishwasher door is fully opened movable member 86 and thus actuation member 82 will move further to the right in FIG. 5 so that control element 116 of switch 84 will engage third ramping surface 110 by which control element 116 is pressed even further until the third plateau surface 112 is reached. In this state, with control element 116 being fully depressed, the switch 84 is set in a fourth switching condition in which a fourth control signal is sent to the device control so as to activate a drain pump and, upon completion of a drain cycle, to fully terminate the washing cycle.

Considering that every position of actuation member 82 in the direction of arrow 114 corresponds to a certain position of the dishwasher door, it is easily to be seen that by selecting the positions of the ramping surfaces, various switching conditions can be assigned to any desired angular position of the door. Further, by selecting corresponding lengths of the plateau surfaces, each of the switching positions can be assigned to a certain angular range of the pivotable door.

50 mounting member
52 bearing journal
54 axle
56 hinge bracket
58 extension spring
60 quick-release means
62 connector
64 lever
66 axle
68 clip
70 tongue
72 plateau surface
74 ramping surface
76 switching element
78 push button
80 oven door
82 actuation member
84 switch
86 movable member
88, 89 fastening members
90 projection
92 hook
94 rim
96 opening
98 legs
100 opening
102 1. ramping surface

104 1. plateau surface
106 2. ramping surface
108 2. plateau surface
110 3. ramping surface
112 3. plateau surface
114 direction of movement of 82
116 control element
118 direction of movement of 116

The invention claimed is:

1. Switching arrangement for detection of displacement of a movable member of a household appliance, comprising:

(a) a switch having a control element which is movable between a first position in which the switch assumes a first switching condition and at least one second position in which the switch assumes a second switching condition; and (b) an actuation member adapted for connection to said movable member and having a cam surface slidingly engaging said control element;

wherein during a movement of said movable member, the actuation member and the control element both engage in a linear movement, and the linear movement of the actuation member is perpendicular to the linear movement of the control element, and wherein said actuation member comprises an elastic clamping section for connection to said movable member.

2. The switching arrangement of claim 1, wherein said switch is a push button switch and said control element comprises a spring-biased stem projecting from said switch, and wherein said cam surface comprises a ramping section to press down said stem.

3. The switching arrangement of claim 2, wherein said ramping section merges into a plateau section to maintain said stem in the pressed down position.

4. The switching arrangement of claim 1, wherein said actuation member comprises a molded plastic part.

5. The switching arrangement of claim 1, wherein said actuation member comprises a slanted cam surface engaging a push button of said switch.

6. A switching arrangement for detection of displacement of a movable member of a household appliance, comprising:

(a) a switch having a control element which is movable between a first position in which the switch assumes a first switching condition and at least one second position in which the switch assumes a second switching condition; and (b) an actuation member adapted for connection to said movable member and having a cam surface engaging said control element;

wherein said actuation member comprises an elastic clamping section for connection to said movable member; and, wherein said clamping section of said actuation member comprises an elastic claw which embraces said movable member.

7. A switching arrangement for detection of displacement of a movable member of a household appliance, comprising:

(a) a switch having a control element which is movable between a first position in which the switch assumes a first switching condition and at least one second position in which the switch assumes a second switching condition; and (b) an actuation member adapted for connection to said movable member and having a cam surface engaging said control element;

wherein said actuation member comprises an elastic clamping section for connection to said movable member; and wherein said clamping section of said actuation member comprises a projection for engaging a recess within said movable member, said projection providing for a lateral biasing force to anchor the projection within said recess.

8. A household appliance comprising a pivotable door and a switching arrangement as defined in claim 1, for detection of displacement of a movable member of a household appliance, said switching arrangement comprising:

(a) a switch having a control element which is movable between a first position in which the switch assumes a first switching condition and at least one second position in which the switch assumes a second switching condition; and (b) an actuation member adapted for connection to said movable member and having a cam surface slidingly engaging said control element wherein during a movement of said movable member, the actuation member and the control element both engage in a linear movement, and the linear movement of the actuation member is perpendicular to the linear movement of the control element, and wherein said movable member is a component of a hinge mechanism for said door, and wherein the switching arrangement further comprises a spring biasing the door towards a closed position.

9. The household appliance of claim 8, wherein said switch is arranged to activate a light for illumination of the interior of said household appliance, when said door is opened.

10. The household appliance of claim 8, wherein said switch is arranged to interrupt operation of said household appliance, when said door is opened.

11. The household appliance of claim 8, wherein said household appliance is an oven or dishwasher comprising a door which is pivotable about a horizontal axis.

12. A household appliance comprising:

a pivotable door; and a switching arrangement for detection of displacement of a movable member of a household appliance comprising:

(a) a switch having a control element which is movable between a first position in which the switch assumes a first switching condition and at least one second position in which the switch assumes a second switching condition; and (b) an actuation member adapted for connection to said movable member and having a cam surface engaging said control element;

wherein said movable member is a component of a hinge mechanism for said door, and wherein said component of said hinge mechanism is subject to a substantially linear movement during movement of said door, and wherein said actuation member comprises a clip which is attached to said component and which comprises a slanted cam surface engaging a push button of said switch.

13. Switching arrangement for detection of displacement of a movable member of a household appliance, comprising:

(a) a switch having a control element which is movable between a first position in which the switch assumes a first switching condition and at least one second position in which the switch assumes a second switching condition; and (b) an actuation member adapted for connection to said movable member and having a cam surface slidingly engaging said control element, wherein said actuation member engages in a substantially linear movement during a movement of said movable member, and wherein said actuation member comprises a slanted cam surface engaging a push button of said switch, and wherein the switch is a multistage switch having different switching conditions that can be actuated by a linear movement of the actuation member.

14. The switching arrangement of claim 13, wherein the actuation member is not in contact with the control element when the control element is in the first position.

* * * * *